US008596030B2

(12) United States Patent
Buchhauser et al.

(10) Patent No.: US 8,596,030 B2
(45) Date of Patent: Dec. 3, 2013

(54) CLOSING DEVICE FOR CONTAINERS HAVING A STERILE SPACE

(75) Inventors: Klaus Buchhauser, Deuerling (DE); Guenter Frankenberger, Koefering (DE)

(73) Assignee: Krones AG (DE)

( * ) Notice: Subject to any disclaimer, the term of this patent is extended or adjusted under 35 U.S.C. 154(b) by 310 days.

(21) Appl. No.: 13/123,488

(22) PCT Filed: Oct. 20, 2009

(86) PCT No.: PCT/EP2009/063709
§ 371 (c)(1),
(2), (4) Date: May 18, 2011

(87) PCT Pub. No.: WO2010/052124
PCT Pub. Date: May 14, 2010

(65) Prior Publication Data

US 2011/0247301 A1 Oct. 13, 2011

(30) Foreign Application Priority Data

Nov. 6, 2008 (DE) ..... 10 2008 056 242

(51) Int. Cl.
*B65B 7/00* (2006.01)

(52) U.S. Cl.
USPC ..... 53/485; 53/426; 53/467; 53/287; 53/510

(58) Field of Classification Search
USPC ..... 53/426, 432, 467, 476, 484, 485, 488, 53/490, 287, 510, 317, 329, 331.5
See application file for complete search history.

(56) References Cited

U.S. PATENT DOCUMENTS

| | | | | |
|---|---|---|---|---|
| 2,931,147 | A * | 4/1960 | Barnby | 53/432 |
| 6,637,749 | B2 * | 10/2003 | Scherman | 277/303 |
| 7,121,062 | B2 * | 10/2006 | Till | 53/167 |
| 8,375,684 | B2 * | 2/2013 | Buchhauser et al. | 53/329 |
| 2002/0029543 | A1 * | 3/2002 | Taggart | 53/426 |

(Continued)

FOREIGN PATENT DOCUMENTS

| | | | |
|---|---|---|---|
| EP | 1821010 | 8/2007 | F16J 15/40 |
| GB | 407672 | 3/1934 | B67C 7/00 |
| WO | WO 2004065283 | 8/2004 | B67C 7/00 |

OTHER PUBLICATIONS

English translation of Office Action issued in corresponding Chinese Application Serial No. 2009801443790, dated Dec. 5, 2012 (5 pgs.).

*Primary Examiner* — Hemant M Desai
(74) *Attorney, Agent, or Firm* — Hayes Soloway P.C.

(57) ABSTRACT

The invention relates to a device for closing containers with closures comprising a closing head (2) that attaches the closures to the containers, wherein said closing head (2) can be moved relative to the closures with a first movement type and is arranged within a sterile space (8) with a first movement unit (4) for producing a movement of the closure with the first movement type, wherein said first movement unit (4) is arranged at least partially outside the sterile space (8), wherein the sterile space (8) is bounded by at least one first wall (12) and the device comprises a ring-shaped channel (14) into which said first wall (12) protrudes, wherein the ring-shaped channel (14) can be moved relative to the first wall (12) and can be filled with a fluid medium, and wherein the first movement unit (4) is arranged within the channel (14) at least in sections.

16 Claims, 2 Drawing Sheets

(56) References Cited

U.S. PATENT DOCUMENTS

2007/0006550 A1* 1/2007 Kemper et al. ..... 53/426
2008/0078144 A1* 4/2008 Cirio ..... 53/359
2009/0151814 A1* 6/2009 Kelly et al. ..... 141/286
2010/0108181 A1* 5/2010 Westner et al. ..... 141/4
2011/0072762 A1* 3/2011 Jakob ..... 53/285

* cited by examiner

CLOSING DEVICE FOR CONTAINERS HAVING A STERILE SPACE

FIELD OF THE INVENTION

The present invention relates to an apparatus for closing containers. Apparatus of this type have long been known from the prior art. In production plants for the production of beverage containers it is usual for these containers to be filled with a beverage and then to be closed with a closure means, such as for example a screw closure or a crown cap.

BACKGROUND OF THE INVENTION

In this case special conditions occur in many areas, for example in the filling of juices. In this way it is necessary for the entire treatment of the containers and also the closure thereof to be carried out inside a sterile or clean space. In this case a longitudinal movement of a closure head with respect to a longitudinal direction of the containers is also necessary to some extent for the closure procedure. Since it is not normally desired for all the elements which are necessary for a longitudinal movement of this type to be placed in the interior of the sterile space, as this would run counter to keeping the latter sterile, attempts have been made to place as many drive elements as possible outside the sterile space. On account of the conditions of the stroke of the closure element which are necessary in a closing means, however, the situation arises that the non-sterile machine parts present outside the sterile space or below a carrier ring project into the sterile region or move into the sterile space. In this way, it is possible for germs to penetrate into the sterile region.

Various apparatus are known from the prior art to achieve a separation between the sterile and non-sterile spaces even in the case of elements moving in this manner. In this way a surge tank or a vapour barrier is provided in some cases to carry out a sealing of this type. On account of the large stroke or the thermal stressing of the components, however, these sealing means can be used to only a limited extent or are difficult to implement.

A machine for the aseptic treatment of containers is known from WO 2004/065283. This has a surge tank in order to separate a rotationally movable part from a stationary region in a sterile manner.

The object of the present invention is therefore to provide an apparatus for closing containers which is also capable of handling comparatively large reciprocating movements of a closure element. This is attained according to the invention by an apparatus according to claim 1. Advantageous embodiments and further developments form the subject matter of the sub-claims.

SUMMARY OF THE INVENTION

An apparatus according to the invention for closing containers with closure means has a closure head which applies the closure means to the containers, this closure head being movable with respect to the containers in a first manner of movement and being arranged inside a sterile space. In addition, the apparatus has a first movement device for producing a movement of the closure head, this first movement device being arranged at least in part outside the sterile space.

According to the invention the sterile space is bounded by at least one first wall and has an annular channel into which this first wall projects, the annular channel being movable with respect to the first wall and being capable of being filled with a liquid medium, and the first movement device being arranged at least locally inside the channel.

On account of the apparatus according to the invention it is made possible for drive elements for producing the movement, for example a reciprocating movement or a rotary movement, to be arranged outside the clean space and nevertheless for a sealed transition into the interior of the sterile space to be possible. The movement device can be a device which produces a specified movement such as a reciprocating movement or a rotary movement. It is preferable, however, for it to be more specifically a movement transmission device which transmits a movement produced in particular outside the sterile space to a moving element inside the sterile space and in particular goes beyond the boundary of the sterile space.

Together with the wall the above-mentioned annular channel forms a so-called surge tank which seals off the non-sterile region from the sterile region. In this case it is suggested according to the invention that this surge tank or this annular channel respectively is also used for passaging the movement device and thus, expressed in more precise terms, the annular channel is also used in order to achieve a sealed-tight passage of the movement device from the non-sterile region into the sterile region. In this way, the channel is also used for the purpose of introducing the aforesaid movement device from the non-sterile region into the sterile region.

In the case of a further advantageous embodiment the apparatus has a first drive device for driving the closure head, this drive device being situated outside the sterile space and being coupled to the movement device. The drive device can be for example an electric motor, but it would also be possible for the drive device to be provided in the form of a guiding curve which effects a reciprocating movement of the movement device and thus also of the closure head.

In this way it is proposed that suitable drive devices such as for example servo motors or even magnetic or hysteresis clutches should be arranged outside the sterile space and also, in a particularly preferred manner, for suitable stroke curves and rolls or other elements which effect a reciprocating movement should be provided outside the sterile space. The actual reciprocating movement is separated in this way from the sterile space by means of the surge tank. Instead of a surge tank, however, it would also be possible for a folding bellows or a diaphragm to be provided for separation purposes.

In the case of a preferred embodiment the closure head is movable with respect to the container in a second manner of movement different from the first and a second movement device for producing this second movement is arranged outside the sterile space. The second manner of movement can in turn be a reciprocating movement, a pivoting movement, a rotary movement and the like. It is preferable for the first manner of movement to be a reciprocating movement and for the second manner of movement to be a rotary movement, so that the closure head is both displaceable in the longitudinal direction of the container and rotatable, in order to apply closure means to the containers.

In this way, it is preferably proposed that as few parts as possible should be arranged in the interior of the sterile space and, expressed in more precise terms, the reciprocating movement and the rotary movement which are necessary in combination for closing bottles should be produced outside the sterile space.

In the case of a further preferred embodiment the apparatus has a further movement device which transmits a movement of the drive element to the closure head. In this way it is possible for example for the reciprocating movement and the rotary movement to be decoupled and for a coupling to be made only in the interior of the sterile space. It is thus proposed in an advantageous manner that the reciprocating movement and the rotary movement should be separated from each other and should be transmitted separately through the boundary of the sterile space and should be coupled to each other only inside the sterile space. As a result, a rotary movement can be transmitted in an aseptic manner into the sterile space with the aid of the surge tank or even with the aid of a suction means. As mentioned, the corresponding reciprocating movement is also transmitted into the sterile space by way of the surge tank or a folding bellows or a diaphragm. In the interior of the sterile space the two components of the movement are joined and, as a result, they fulfil the function of applying the closure means to containers.

In the case of a further advantageous embodiment the first movement device and the second movement device are thus separated from each other. It would also be possible, however, for the rotary movement to be produced for example by an electric motor and for this electric motor to be raised and lowered as a whole, so that for example only a rotatable and displaceable movement device is provided which supplies closure means to the containers. In the case of a further preferred embodiment at least one manner of movement is a rotary movement, and in the case of a further advantageous embodiment at least one manner of movement is a reciprocating movement, in particular in a longitudinal direction of the containers.

In the case of a further advantageous embodiment the apparatus also has a second drive device for driving the closure head, the second drive device being arranged outside the sterile space. In this way, the first drive device can be a stroke curve and the second drive device can be an electric motor which produces the rotary movement.

In the case of a further advantageous embodiment a driving wheel, the rotary movement of which is coupled to at least one drive device, is provided in the interior of the sterile space, as well as a wheel driven by this driving wheel, the driven wheel being displaceable with respect to the driving wheel in the direction of the axis of rotation of the driven wheel. It is preferable for the driven wheel and the driving wheel to be toothed wheels in each case. On account of this displaceability the reciprocating movement of the closure head can be coupled to the rotary movement thereof.

It is preferable for the driving wheel to be a "long wheel", i.e. a wheel which is considerably longer in the direction of its axis of rotation than the driven wheel. In a corresponding manner, however, the driven wheel could also be a "long wheel" of this type.

In the case of a further advantageous embodiment the apparatus has a second movement device which transmits a movement of the second drive device to the driving toothed wheel, in which case it is also preferable for the second drive device to extend through the annular channel. It is preferable for at least one of the drive devices to be designed in the form of an electric motor.

In the case of a further advantageous embodiment the (first) movement device extends at least in part inside a hollow body, this hollow body being arranged inside the aforesaid channel. It is preferable for this to be a cylindrical body with, in a particularly preferred manner, a circular cross-section. In this case this hollow body is preferably arranged in a fixed manner on the aforesaid channel and is completely surrounded by separating media. This separating medium can be water for example, but also sterile or sterilizing or disinfecting liquids.

In the case of a further advantageous embodiment a cylindrical body, which projects into the channel and which completely surrounds the movement device in the peripheral direction, is arranged on the movement device. It is preferable for this cylindrical body also to surround the above-mentioned hollow body completely in the peripheral direction. It is preferable for this body also to be situated always in the liquid, i.e. irrespectively of any reciprocating setting of the movement device. In this way an advantageous sealing of the two elements, i.e. the movement device and the hollow body, with respect to each other can be achieved.

In addition, the present invention relates to an apparatus for closing containers with closure means, with a closure head which appies the closure means to the containers, this closure head being movable with respect to the closure means in a first manner of movement and being arranged inside a sterile space. In addition, the apparatus has a first movement device for producing a movement of the closure head in the first manner of movement, this first movement device being arranged at least in part outside the sterile space.

According to the invention the sterile space is bounded by at least one first wall and the apparatus has a container which is capable of being filled with a liquid medium, and the first movement device is arranged at least locally inside the container.

In the case of this apparatus according to the invention the principle stated above is generalized inasmuch as the container is not necessarily a surge tank for sealing a rotary movement, but rather a container is provided which is used specially for sealing the movement in the manner of movement described and, in particular, a reciprocating movement. In this case it is preferable for the movement device to be completely surrounded by the liquid medium, but it does not touch this medium directly.

In addition, in this case too a cylindrical body is preferably provided, inside which the movement device extends and, in addition, it is also preferable for the movement device to have provided on it a sealing element or a further hollow body which is permanently, i.e. always independently of a reciprocating position of the movement device, immersed in the liquid medium.

Within the scope of the present invention the above arrangements are described only for apparatus for closing containers, but it is pointed out that the invention illustrated is also capable of being applied to other types of plant which have a sterile space and have to handle reciprocating movements. The Applicants therefore reserve the right also to claim the present invention for other types of plant for the treatment of containers.

In addition, the present invention relates to a method of closing containers with closure means, the containers being guided through a sterile space for this purpose and the closure being carried out with the aid of a closure head and the closure head being moved in a first manner of movement in order to close the containers and the movement in this first manner of movement being produced by a first movement device which is arranged at least in part outside the sterile space and preferably also at least in part inside the sterile space. In particular, this movement device is moved with respect to the sterile space.

According to the invention the sterile space is bounded by at least one first wall and has an annular channel into which this first wall projects, the annular channel being moved with respect to the first wall and being filled with a liquid medium, and the first movement device being moved at least locally inside the channel.

In this case it is preferable for the containers to be moved inside the sterile space and, in a particularly preferred manner, along a substantially circular path.

BRIEF DESCRIPTION OF THE DRAWINGS

Further advantages and embodiments are evident from the accompanying drawings. In the drawings

DETAILED DESCRIPTION OF THE INVENTION

Figure 1:
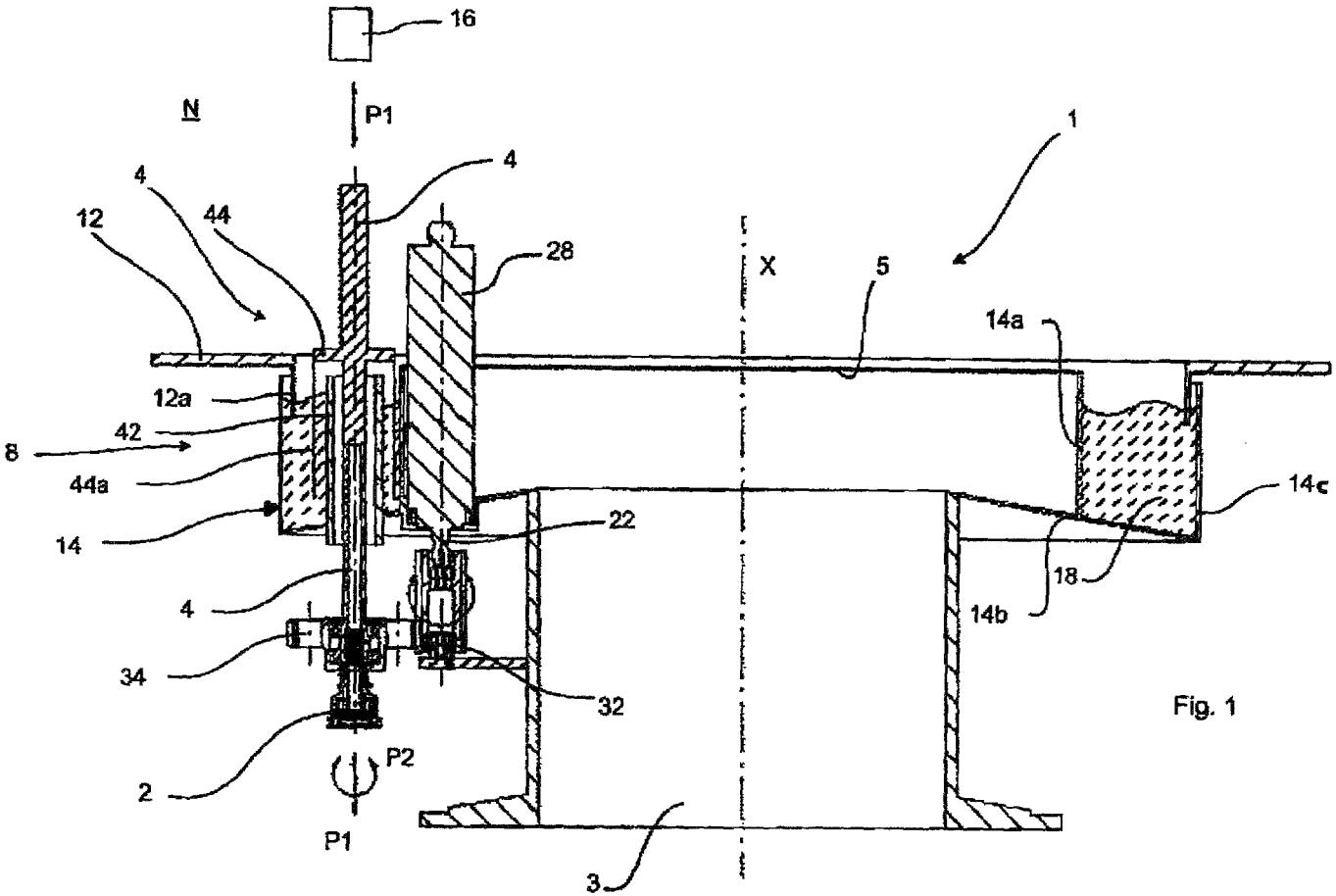
FIG. 1 is a diagrammatic illustration of an apparatus according to the invention [in] a first embodiment.

FIG. 1 is a diagrammatic illustration of an apparatus 1 according to the invention for closing containers (not shown). In this case this apparatus 1 has a central shaft 3 on which a carrier 5 is arranged. A plurality of closure heads 2, which close containers (not shown) with closure means, are arranged on this carrier. In this case these individual closure heads 2 are rotated jointly with the carrier 5 with respect to an axis of rotation X and during this rotation a closure of the containers is carried out. The individual closure heads 2 are arranged permanently inside a sterile space 8.

The reference number 16 relates to a drive device which moves the closure heads along the arrow P1, i.e. upwards and downwards in this case. This drive device 16 can be designed in this case in the form of a stroke curve, which in particular is situated in the region N, i.e. outside the sterile space 8. In order to seal the sterile space 8 off from the external space N a so-called surge tank is used in this case. This surge tank has an annular channel 14 which is filled with a liquid 18. The reference number 12 relates to a stationary wall which likewise bounds the sterile space 8. In this case a portion 12*a* projects permanently into the liquid 18, so that in this way a seal is produced between the stationary and the rotating parts of the apparatus.

The drive device 16 transmits the reciprocating movement to a movement device 4, and the movement device 4 is coupled in turn to the closure head 2 arranged in the interior. In this case, as may be seen from FIG. 1, this movement device extends through the channel 14 and it is thus arranged locally inside the sterile space 8 and in part outside it. The reference 14*a* relates to an inner wall of the channel 14, the reference 14*b* relates to a base of the channel 14, which, as is evident in this case, slopes obliquely outwards in a radial manner, and the reference 14*c* relates to a (radially) outer wall of the channel. In particular, the outer wall can not only terminate at its upper end in a cylindrical manner, as shown in FIG. 1, but it can also have a fold directed radially inwards. This fold (not shown) can be also present in duplicate or it can be formed as a rounded portion, i.e. the end of the wall is directed substantially towards the level of the liquid 18. This prevents, in an advantageous manner, the liquid 18 from spilling over out of the channel 14 into the sterile space 8 in the event of a reduction in the rotational speed of the apparatus 1.

In addition, it is evident from FIG. 1 that the movement device 4 is arranged radially inside the wall portion 12*a*. On account of the procedure according to the invention it is made possible for the same channel 14 which is used for sealing off the sterile space 8 also to be used for sealing off the movement of the movement device 4 which projects into the sterile space 8 from the outside.

The reference number 28 relates to a further drive device which has an electric motor which provides for a rotary movement of the closure head 2. In this case this electric motor is arranged radially inside the annular channel 14. In order that the movement which the drive device 28 produces can be likewise sealed off, it would be possible for a sealing ring or the like to be inserted for example in the region of the movement device 22, for example a driven shaft of the electric motor, in order to prevent the entry of contamination into the sterile space. It would also be possible for a gas suction means to be provided in this region.

In addition, however, it would also be possible to guide the movement device 22 through the annular channel 14, for example behind or in front of the movement device 4 in FIG. 1.

The movement device 22 drives a drive wheel 32 which is designed in this case in the form of a long wheel which extends significantly further in the direction of the reciprocating movement P1 than a wheel 34 driven by it. This means that the driven wheel 34 always engages in the driven wheel 32, irrespectively of a stroke position of the movement device 4.

The reference number 42 relates to a cylindrical body which in this case is arranged in the annular channel 14 and preferably in a fixed manner in the latter. The movement device 4 is guided inside this cylindrical body, as a result of which a seal between the sterile space 8 and the region outside the sterile space 8 is likewise achieved in this case. A further cylindrical body 44 is arranged on the movement device 4, in which case a peripheral wall 44*a* of the cylindrical body 44 always projects into the liquid 18, i.e. irrespectively of a position of the movement element.

In this case it should be noted that the sterile space 8 would be connected to the region N outside the sterile space 8 by way of the hollow body 42. On account of the interaction of the cylindrical body 44, or expressed in more precise terms the peripheral wall 44*a* arranged on the latter, a seal is likewise achieved by way of the liquid 18.

It would also be possible in this case, however, for a further liquid container, inside which the peripheral walls 44*a* [are] movable, to be arranged inside the channel 14. In addition, it would also be possible for the movement element 4 to move outside the annular channel, and for a hollow body 42 likewise to be provided which is arranged inside a water container and with respect to which the peripheral wall 44*a* in turn is movable. The Applicants therefore retain the right likewise to claim a seal hereinafter, in which a movement element 44 is guided inside a liquid container.

In this case it should be noted that the sealing movement in the present case is not a transversal movement but a reciprocating movement which can take place inside this water container. In an advantageous embodiment a plurality of containers, in which a liquid is present in each case and in [which] cylindrical bodies 44 of the type shown in FIG. 1 could additionally be arranged in each case, can be arranged for example on the carrier. In this it would also be possible for the aforesaid containers to be connected to one another in the manner of communicating tubes.

The advantage of the embodiment shown in FIG. 1, however, is that only one channel to be filled is provided and can thus be operated with relatively few status sensors or the like which monitor a status level of the liquid 18.

Figure 2:
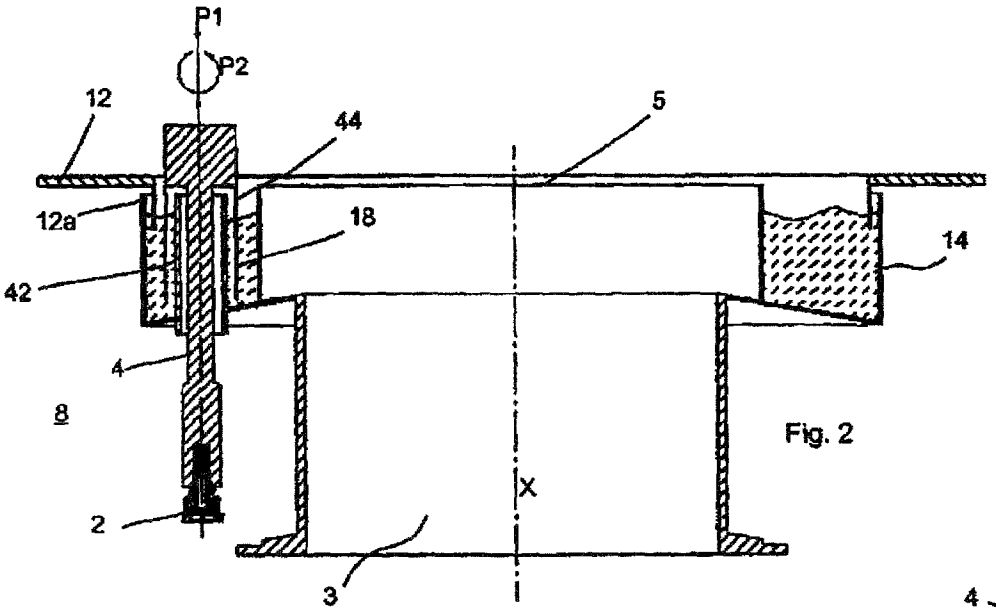
FIG. 2 is a diagrammatic illustration of an apparatus according to the invention in a second embodiment.

FIG. 2 shows a further embodiment of the apparatus according to the invention. With respect to the arrangement of the annular channel 14, this apparatus corresponds to the embodiment shown in FIG. 1. An essential difference from the embodiment shown in FIG. 1 is that only one movement device 4 is provided, which transmits both a reciprocating movement and a rotary movement. In this way it would be possible for example for a drive device such as a motor, which is likewise however moved along the double arrow P1 by a reciprocating movement for example, to be provided outside the sterile space 8. In addition, it would also be possible for a suitable electric motor to be held in a stationary manner and for a movement device in the manner of a telescope, which in turn transmits the reciprocating movement to the closure head 2, to be provided in each case.

Figure 3:
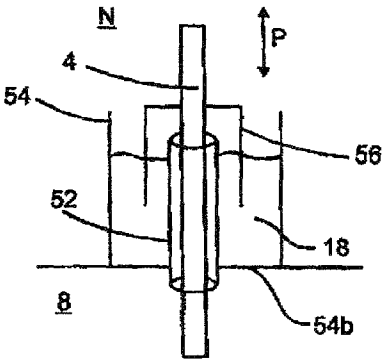
FIG. 3 is a further illustration to explain the present invention.

FIG. 3 explains in a diagrammatic manner the concept underlying the present invention. According to this a container 54 with a base 54*b* is provided in this case. A hollow cylinder 52 is provided inside this container 54, this hollow cylinder 52 being connected to the base 54*b* in a liquid-tight manner and being completely surrounded by liquid 18. A second cylindrical body 56, which moves with the movement device 4, is in turn arranged on the movement device 4. The movement in FIG. 3 is a reciprocating movement, but it would also be possible for a rotary movement to be sealed. In this way, the sterile space 8 is always sealed off from the outer region N irrespectively of a setting of the movement device 4.

All the features disclosed in the application documents are claimed as being essential to the invention, insofar as they are novel either individually or in combination as compared with the prior art.

The invention claimed is:

1. An apparatus for closing containers with closures, having a closure head which applies the closures to the containers, wherein this closure head is movable with respect to the closures in a first manner of movement and is arranged inside a sterile space, with a first movement device for producing a movement of the closures in the first manner of movement, wherein this first movement device is arranged at least in part outside the sterile space, wherein the sterile space is bounded by at least one first wall and the apparatus has an annular channel into which this first wall projects, wherein the annular channel is movable with respect to the first wall and is being filled with a liquid medium and wherein the first movement device is arranged at least locally inside the channel.

2. An apparatus according to claim 1, wherein the apparatus has a first drive device for driving the closure head, wherein this drive device is situated outside the sterile space and is coupled to the movement device.

3. An apparatus according to claim 1, wherein the closure head is movable with respect to the container in a second manner of movement different from the first manner of movement.

4. An apparatus according to claim 3, wherein the apparatus has a second movement device which transmits a movement of the drive element to the closure head.

5. An apparatus according to claim 4, wherein the first movement device and the second movement device are separated from each other.

6. An apparatus according to claim 1, wherein at least one manner of movement is a rotary movement.

7. An apparatus according to claim 1, wherein at least one manner of movement is a reciprocating movement, in particular in a longitudinal direction of the containers.

8. An apparatus according to claim 1, wherein the manners of movement are coupled in the interior of the sterile space.

9. An apparatus according to claim 1, wherein the apparatus has a second drive device for driving the closure head, wherein the second drive device is arranged outside the sterile space.

10. An apparatus according to claim 1, wherein a driving wheel, the rotary movement of which is coupled to at least one drive device, is provided in the interior, as well as a driven wheel driven by this driving wheel, wherein the driven wheel is displaceable with respect to the driving wheel in the direction of the axis of rotation of the driven wheel.

11. An apparatus according to claim 1, wherein the apparatus has a second movement device which transmits a movement of the second drive device to the driving wheel, wherein it is also preferable for the second drive device to extend through the annular channel.

12. The apparatus according to claim 11, wherein the driving wheel is a toothed wheel.

13. An apparatus according to claim 1, wherein the movement device extends at least in part inside a hollow body, wherein this hollow body is arranged inside the channel.

14. An apparatus according to claim 13, wherein a cylindrical body, which projects into the channel and which completely surrounds the movement device in the peripheral direction, is arranged on the movement device.

15. An apparatus for closing containers with closures, having a closure head which moves the closures to the containers, wherein this closure head is movable with respect to the closures in a first manner of movement and is arranged inside a sterile space, with a first movement device for producing a movement of the closures in the first manner of movement, wherein this first movement device is arranged at least in part outside the sterile space, wherein the sterile space is bounded by at least one first wall and the apparatus has a container which is capable of being filled with a liquid medium, and the first movement device is arranged at least locally inside the container.

16. A method of closing containers with closures the method comprising:

guiding the containers through a sterile space and carrying out the closure with the aid of a closure head;

producing a first manner of movement by a first movement device in order to close the containers said first movement device is arranged at least in part outside the sterile space;

bounding the sterile space by at least one first wall and providing an annular channel into which said first wall projects; and moving the annular channel with respect to the first wall, wherein the annular channel is filled with a liquid medium and wherein the first movement device is moved at least locally inside the channel.

* * * * *